US006863496B2

(12) United States Patent
Cho et al.

(10) Patent No.: US 6,863,496 B2
(45) Date of Patent: Mar. 8, 2005

(54) FAN AND SHROUD ASSEMBLY

(75) Inventors: Kyung-Seok Cho, Daejeon (KR); Ok-Ryul Min, Daejeon (KR); Chang-Ho Park, Daejeon (KR); Se-Young Park, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 0 days.

(21) Appl. No.: 10/373,075

(22) Filed: Feb. 26, 2003

(65) Prior Publication Data

US 2003/0161728 A1 Aug. 28, 2003

(30) Foreign Application Priority Data

Feb. 27, 2002 (KR) ..... 2002-10389

(51) Int. Cl.[7] ..... F01D 11/02

(52) U.S. Cl. ..... 415/173.5; 415/220; 415/222; 415/223; 415/208.1; 415/211.2

(58) Field of Search ..... 415/173.5, 173.6, 415/173.1, 220, 222, 223, 208.1, 211.1, 211.2, 173.4, 186, 208.5; 416/189, 192, 169 A; 123/41.49; 277/411, 412, 414

(56) References Cited

U.S. PATENT DOCUMENTS 4,311,431 A * 1/1982 Barbeau ..... 415/173.6
4,548,548 A * 10/1985 Gray, III ..... 416/189
4,738,586 A * 4/1988 Harter ..... 415/173.5
5,443,363 A * 8/1995 Cho ..... 415/211.1
5,489,186 A 2/1996 Yapp et al.
6,113,347 A 9/2000 Forrester
6,254,343 B1 7/2001 Schmidt et al.
6,270,313 B1 * 8/2001 Chuang et al. ..... 415/148
6,398,492 B1 * 6/2002 Cho et al. ..... 416/169 A
6,499,948 B1 * 12/2002 Iyer et al. ..... 415/220

FOREIGN PATENT DOCUMENTS

DE 19860515 6/2000
JP 59168300 9/1984

* cited by examiner

*Primary Examiner*—Christopher Verdier
(74) *Attorney, Agent, or Firm*—Lowe Hauptman & Berner, LLP

(57) ABSTRACT

A fan and shroud assembly includes a fan having a hub rotating around one shaft and a plurality of blades extending outwardly from the hub, a shroud encompassing the fan to adjust airflow by rotation of the fan, a guide ring portion located at a position where a predetermined gap exists between the shroud and a circumference connecting end tips of the blades so that the fan is supported by the shroud and rotates, and a plurality of swirl prevention units integrally formed with the guide ring portion to prevent a vortex from proceeding along the circumference in the predetermined gap, each swirl prevention unit having a shape in which the length of a circular arc passing through each of the swirl prevention units with respect to the center of the shroud decreases as the arc is closer to the center of the shroud.

12 Claims, 11 Drawing Sheets

FAN AND SHROUD ASSEMBLY

BACKGROUND OF THE INVENTION

This application claims the priority of Korean Patent Application No. 2002-10389 filed on 27 Feb. 2002 in the Korean Intellectual Property Office, the disclosure of which is incorporated herein in its entirety by reference.

1. Field of the Invention

The present invention relates to a fan and shroud assembly, and more particularly, to a fan and shroud assembly in which swirl prevention units are arranged at an airflow inlet of a shroud where a fan is inserted so that swirling of airflow generated during airflow by rotation of the fan is reduced and thus air can be blown with effectively lowered noise.

2. Description of the Related Art

As shown in FIG. 12, a fan 10 used for cooling of a heat exchange medium passing the inside of a heat exchanger such as radiator or condenser of a car includes a hub 11 coupled to a shaft of a driving source such as a motor, and a plurality of blades 12 radially arranged along the outer circumference surface of the hub 11. A fan band 13 connecting end tips of blades 12 can be further provided to prevent deformation of the blades 12. Thus, as the fan 10 rotates by a rotating force transferred from the driving source to the hub 11, air can be blown by the blades 12 in an axial direction. A shroud may be fixed to a heat exchanger to effectively guide the air blown by the fan 10 toward the heat exchanger. The shroud may have an airflow inlet sized to insert the fan 10 to be rotated therein to guide airflow and be formed to support the motor as a driving source.

Here, the shroud constituting a puller type fan shroud assembly which is installed, for example, at the rear of the heat exchanger to suck air and to blow the air to the rear of the heat exchanger will be described below. Referring to FIGS. 10 and 11, a shroud 20 includes a housing 21 into which the fan 10 can be rotatably inserted and having an airflow inlet 22 to guide the flow of air by the fan 10, a motor support ring 23 provided at the center of the airflow inlet 22, and a plurality of guide ribs 24 radially arranged while connecting the housing 21 and the motor support ring 23 to support the motor support ring 23.

The airflow inlet 22 is formed by an outer guide ring 25 protruding to the rear of the housing 21. For a smooth airflow, a bell mouth 26 is formed at the rear end of the outer guide ring 25 bent inwardly and an inner guide ring 27 can be extended to the front side from an inner end portion of the bell mouth 26. The fan 10 is installed to have a predetermined gap with the inner guide ring 27 at a position where the fan band 13 (the end tips of the blades 12 when the fan band 13 is not present) corresponds to the rear end of the bell mouth 26. The leading end of the fan band 13 is extended toward the outer guide ring 25 and encompasses the leading end of the inner guide ring 27 for a smooth airflow.

The above structure of the airflow inlet 22 and the fan band 13 has been suggested to minimize generation of noise by reducing the generation of air swirling at the end portion of the blades 12 during rotation of the fan 13. However, air actually comes through a gap between the outer guide ring 25 and the outer circumferential surface of the fan band 13 so that air swirling occurs in a space between the outer guide ring 25 and the inner guide ring 27 and flows reversely to the airflow direction. Thus, the amount of airflow is lost due to the reverse airflow and noise is generated due to the air swirling.

In the meantime, U.S. Pat. No. 6,254,343 discloses a low noise cooling fan. In the cooling fan, a housing where a rotor having a plurality of fan blades is installed has a path connecting a first end portion forming an inlet and a second end portion forming an outlet. The inlet has a sectional area greater than the path. A transitional area connecting the inlet and the path and the inlet define a steep step. Also, the inlet has an inner side surface parallel to a passage for fluid and a plurality of protrusions are formed on the inner side surface.

In the above cooling fan, although air suction noise at an edge of the inlet is reduced by the step and the protrusions, noise generated due to swirl at the end tips of the fan blades cannot be reduced. That is, since air swirling is generated between the end tips of the fan blades and the inner circumferential surface of the path by the rotation of the end tips of the fan blades constituting the rotor, noise is generated greatly and further an efficiency of airflow is deteriorated.

Also, U.S. Pat. No. 5,489,186 discloses a fan and housing assembly where a plurality of vanes are installed at a gap between a housing and a fan band and a reversing airflow is controlled by the vanes.

However, in the above fan and housing assembly, although the reverse airflow from the downstream at a high pressure to the upstream at a lower pressure can be controlled, since the vanes made of a thin member are arranged at an identical interval and protrude toward a path of the housing, air swirling generated in the same direction as a direction in which a fan rotates cannot be effectively prevented. Accordingly, a noise reduction effect cannot be greatly improved.

SUMMARY OF THE INVENTION

To solve the above and other problems, the present invention provides a fan and shroud assembly which can effectively reduce noise generated when air is blown by the rotation of a fan and improve an efficiency of airflow.

According to an aspect of the present invention, a fan and shroud assembly comprises a fan having a hub rotating around one shaft and a plurality of blades extending outwardly from the hub, a shroud encompassing the fan to adjust airflow by rotation of the fan, a guide ring portion located at a position where a predetermined gap exists between the shroud and a circumference connecting end tips of the blades so that the fan is supported by the shroud and rotates, and a plurality of swirl prevention units integrally formed with the guide ring portion to prevent a vortex from proceeding along the circumference in the predetermined gap, each swirl prevention unit having a shape in which the length of a circular arc passing through each of the swirl prevention units with respect to the center of the shroud decreases as the arc is closer to the center of the shroud.

Each of the swirl prevention units comprises a first surface facing a direction in which the fan rotates and a second surface facing opposite to the direction in which the fan rotates.

A first angle made by the first surface and a radius line from the center of the shroud to the first surface is greater than a second angle made by the second surface and the radius line.

The first angle is not less than 20° and not greater than 80° while the second angle is not less than −15° and not greater than 45°.

The swirl prevention units are arranged to be continuously connected to one another.

Each of the swirl prevention units further comprises a third surface connecting the first and second surfaces.

A first angle made by the first surface and a radius line from the center of the shroud to the first surface is greater than a second angle made by the second surface and the radius line.

The third surface has a curvature whose radius is defined by a length from the center of the shroud to the third surface.

The fan further comprises a band connecting end tips of the blades.

The guide ring portion further comprises a bell mouth extending to the inside of the guide ring portion at a rear end of the guide ring portion located at a rear side of the shroud and bent such that a path through which air passes is decreased toward the inside of the guide ring portion.

The fan and shroud assembly blows the air toward a heat exchanger.

In the fan and shroud assembly having the above structure according to the present invention, when the fan rotates by the motor supported by the shroud, air is sucked from the front side of the fan by the rotation of the blades and exhausted to the rear of the fan. The air is guided to the rear side of the shroud by the guide ring portion of the shroud and smoothly exhausted.

In the conventional shroud, several vortexes rotating in the same direction as a direction in which the fan rotates are generated by the rotation of the blades between the inner circumferential surface of the guide ring portion and the end tips of the blades or the band connecting the end tips of the blades. These vortexes increase noise and cause loss of the amount of airflow. However, in the present invention, the vortex phenomenon is minimized, for example, by the swirl prevention units having an inclined surface inclined in the direction in which the fan rotates.

While this invention has been particularly shown and described with reference to preferred embodiments thereof, it will be understood by those skilled in the art that various changes in form and details may be made therein without departing from the spirit and scope of the invention as defined by the appended claims.

BRIEF DESCRIPTION OF THE DRAWINGS

The above features of the present invention will become more apparent by describing in detail preferred embodiments thereof with reference to the attached drawings in which.

DETAILED DESCRIPTION OF THE INVENTION

Figure 1:
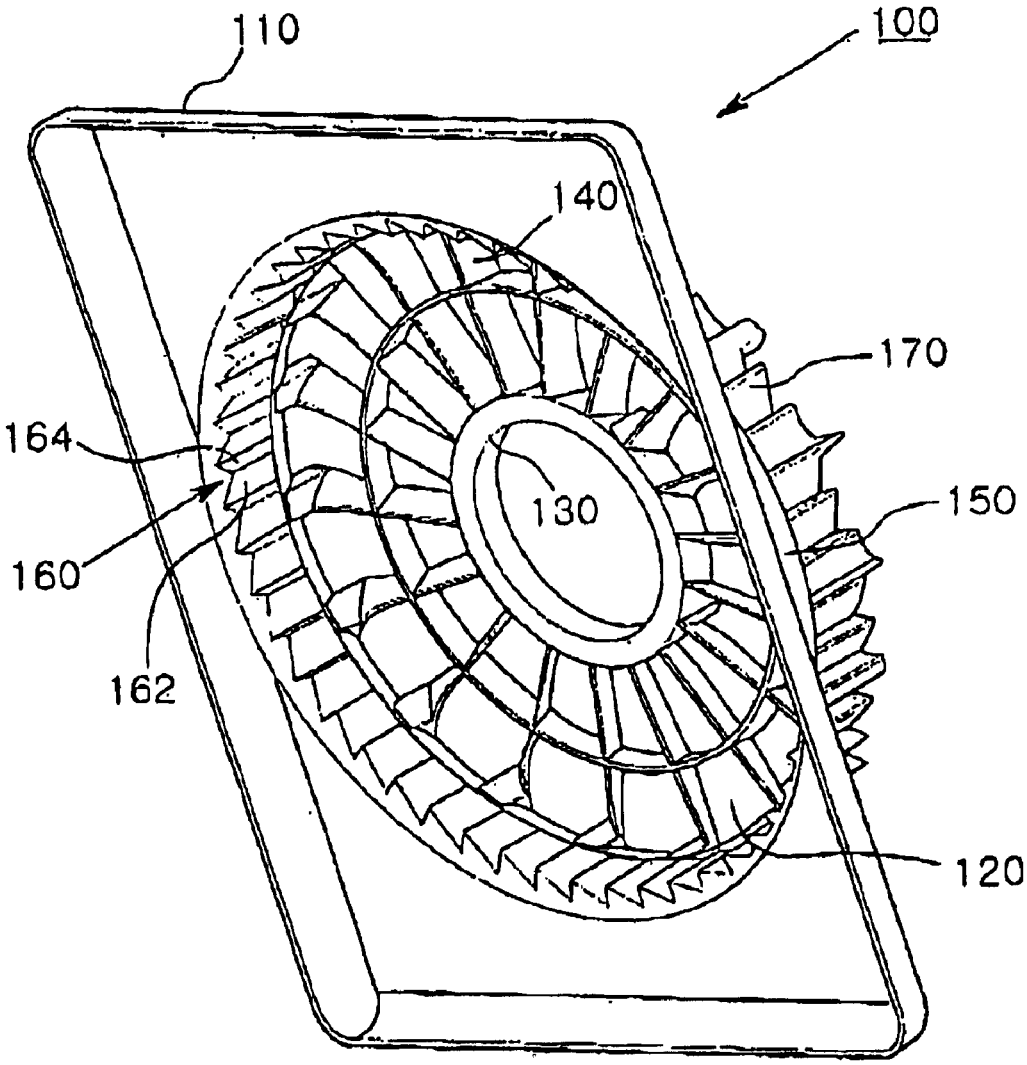
FIG. 1 is a perspective view illustrating a shroud according to a preferred embodiment of the present invention.
Figure 2A:
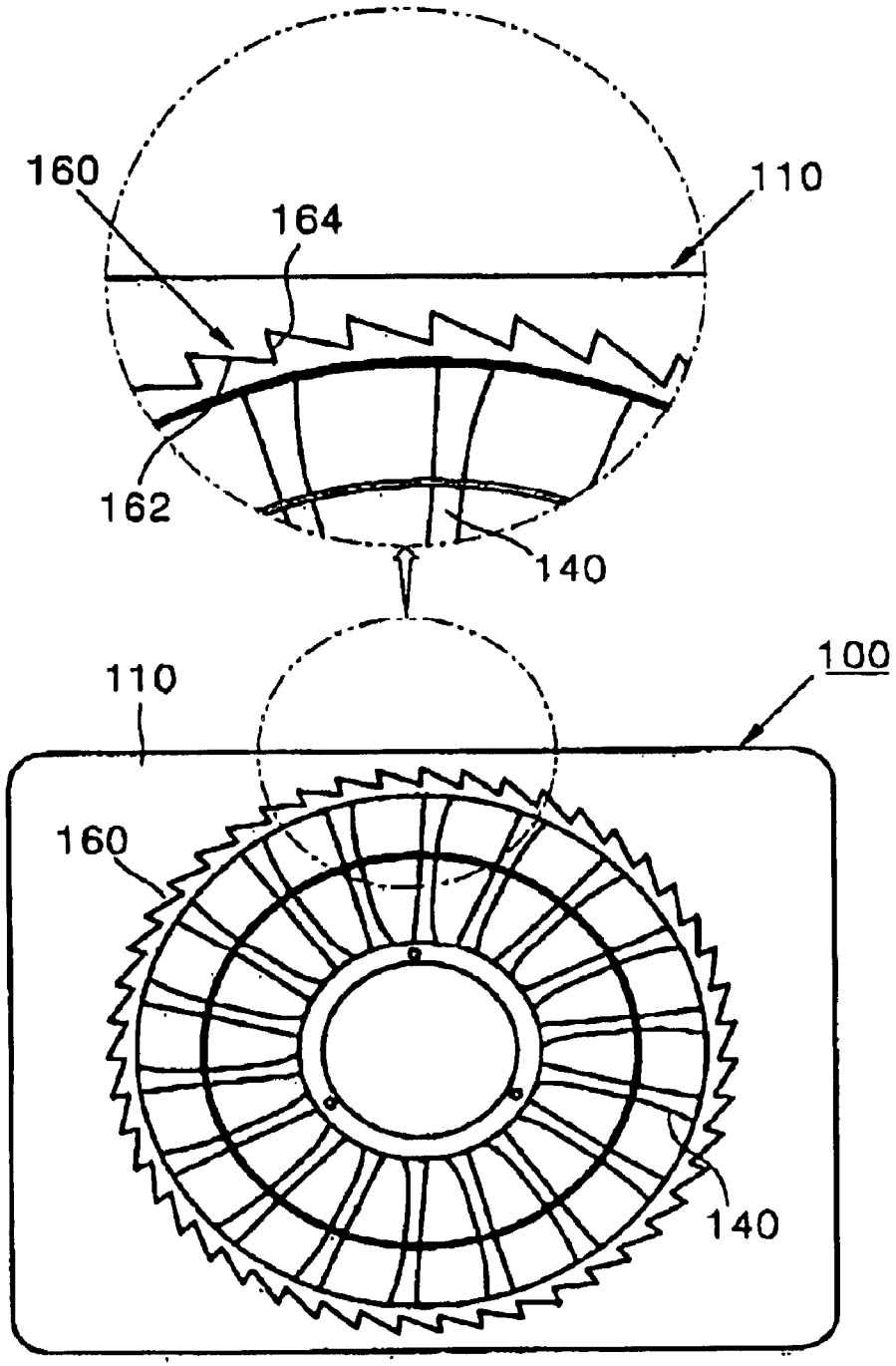
FIG. 2A is a front side view illustrating the shroud of FIG. 1.
Figure 3:
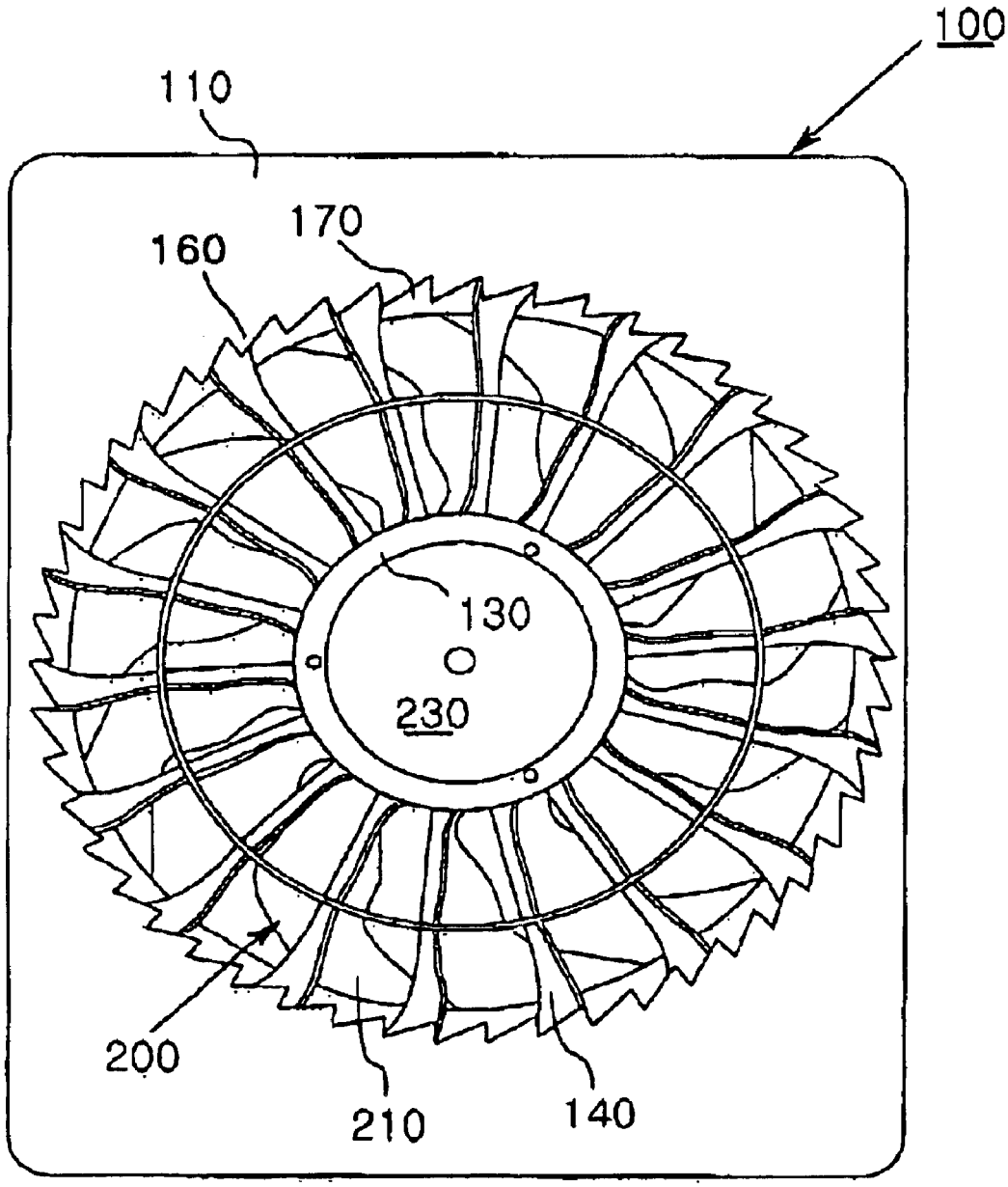
FIG. 3 is a rear side view illustrating a fan and shroud assembly made by combining the shroud and a fan according to the present invention.
Figure 4:
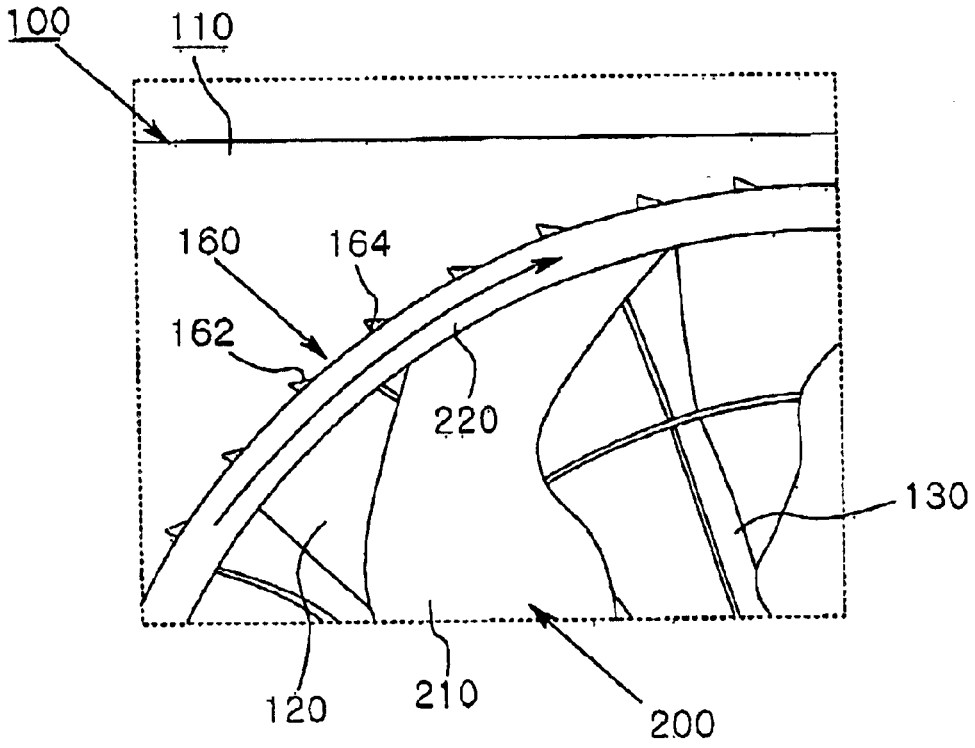
FIG. 4 is a magnified view illustrating part of the fan and shroud assembly of FIG. 3 viewed from the front side.

Referring to FIGS. 1 and 2A, a shroud 100 according to the present invention includes a housing 110 having an airflow inlet 120 into which a fan 200 (refer to FIG. 3) is rotatably inserted, a motor support ring 130 supporting a motor (not shown) rotating the fan 200 at the center of the airflow inlet 120 of the housing 110, and a plurality of guide ribs 140 supporting the motor support ring 130 and radially connecting the motor support ring 130 and the housing 110 to guide air exhausted during rotation of the fan 200.

The housing 110 having a shape concaved to the rear thereof so as to effectively guide sucked air toward the airflow inlet. Here, a plurality of coupling ribs (not shown) are formed at the edge of the housing 110 so that the housing 110 is coupled to a heat exchanger.

Figure 5:
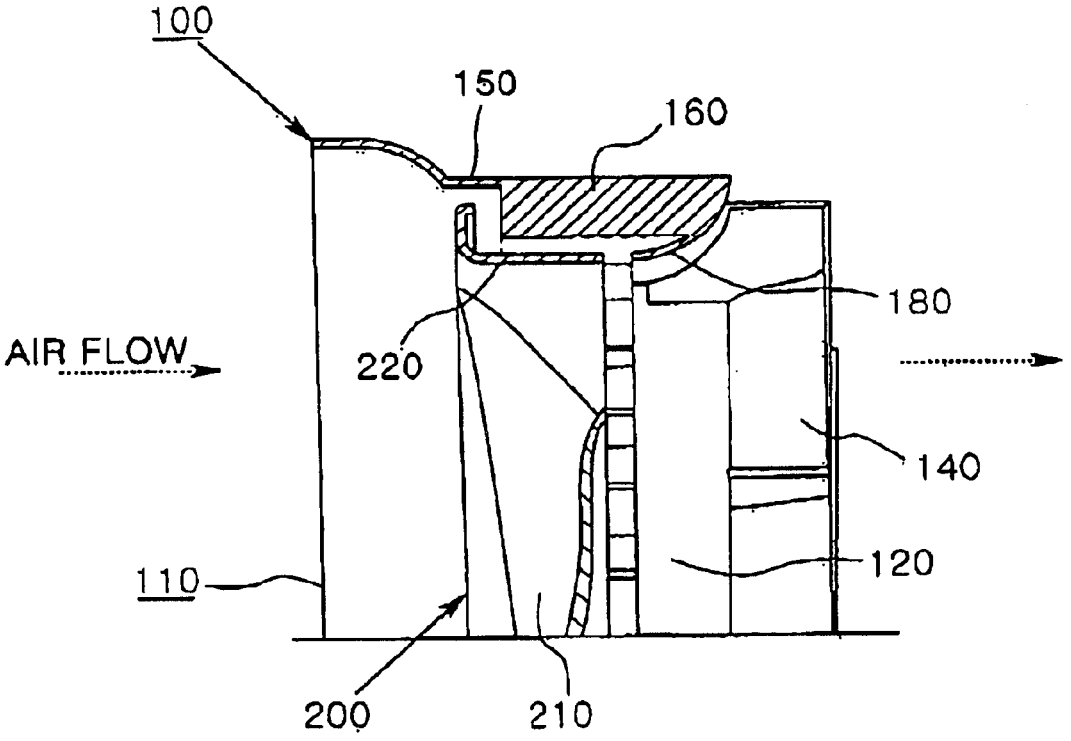
FIG. 5 is a sectional view illustrating part of the fan and shroud assembly of FIG. 3.

The airflow inlet 120 is formed by a guide ring portion 150 protruding to the rear of the housing 110. As shown in FIG. 5, a bell mouth 180 bent from the rear end of the guiding ring portion 150 and a plurality of swirl prevention units 160 toward the inside of the guide ring portion 150 to guide a smooth exhaust of air may be further provided. However, the present invention is not necessarily limited thereto and the airflow inlet 120 can be formed with only the guide ring portion 150 without the bell mouth 180.

According to the present invention, the swirl prevention units 160 are formed along an inner circumferential surface of the airflow inlet 120, that is, an inner circumferential surface of the guide ring portion 150. When the bell mouth 180 is provided, preferably, the swirl prevention units 160 are integrally formed on an inner circumferential surface of a portion connected to the bell mouth 180 of the guide ring portion 150.

Figure 2B:
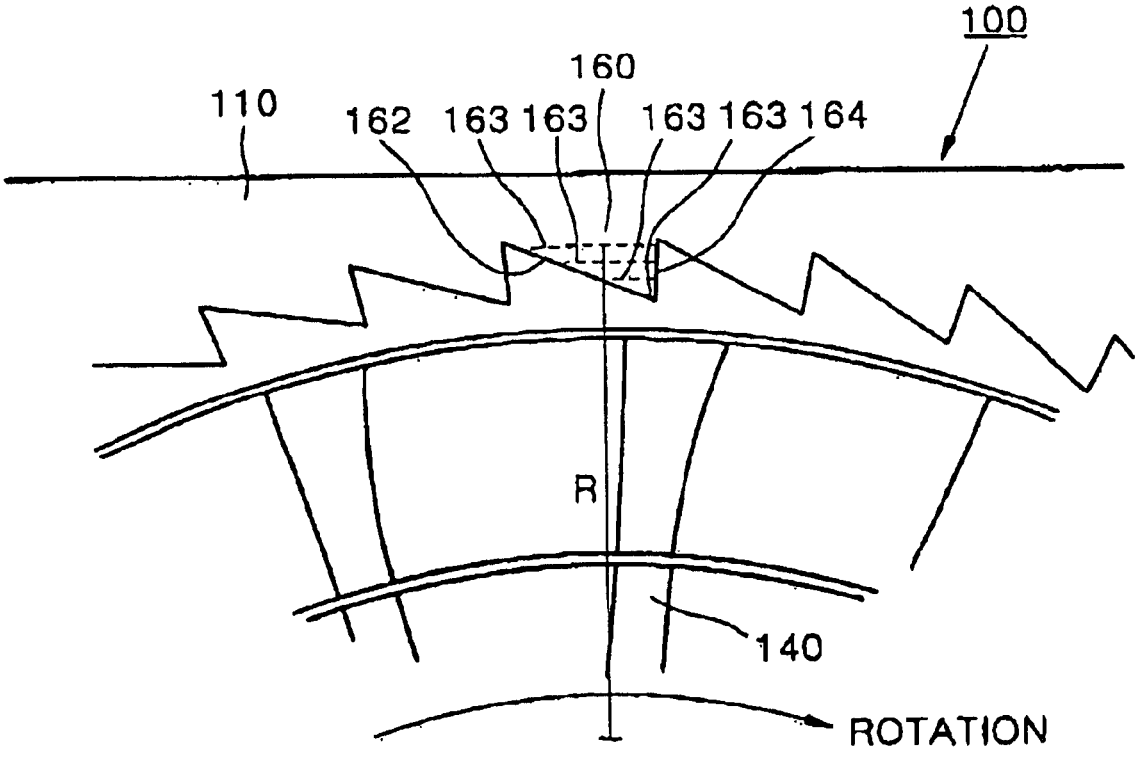
FIG. 2B is a magnified view illustrating a swirl prevention unit according to the present invention.

The swirl prevention units 160 are arranged to maintain a predetermined gap with end tips of a plurality of blades 210 of the fan 200 or a band 220 connecting end tips of the blades 210. Each of the swirl prevention units 160, as shown in FIG. 2B, has a shape such that the length of a circular arc 163 passing each of the swirl prevention units 160 with respect to the center of the shroud 100 decreases as it is closer to the center of the shroud 100. Preferably, each of the swirl prevention units 160 has a first surface 162 facing a direction in which the fan 200 rotates and a second surface 164 facing the opposite direction.

Figure 6:
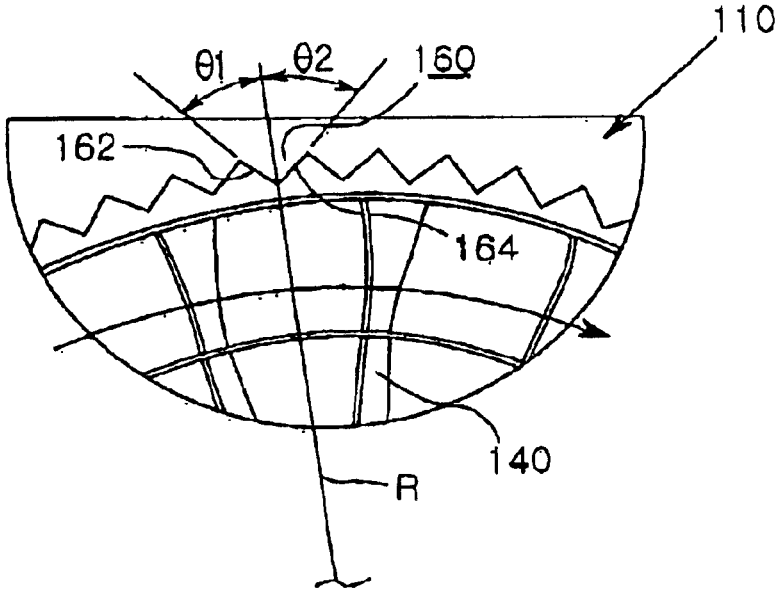
FIG. 6 is a front side view illustrating part of the shroud of FIG. 3 to depict inclination of two surfaces constituting the swirl prevent unit of the shroud according to the present invention.

As shown in FIG. 6, assuming that a first angle made by the first surface 162 with respect to a radius line R of the airflow inlet 120, that is, a radius line from the center of the shroud to the first surface is θ1, and that a second angle made by the second surface 164 with respect to the radius line R is θ2, the first angle θ1 and the second angle θ2 have a preferable relationship such that the second angle θ2 is 0° with respect to the radius line R and the first angle θ1 is within a range of being greater than 0° and less than 90°. Thus, the first surface 162 is inclined in a direction in which the fan 200 rotates and the second surface 164 is perpendicular to the direction in which the fan 200 rotates.

On the contrary, as the first surface 162 can be formed such that the first angle θ1 is 0°. The second surface 164 can be formed such that the second angle θ2 is within a range of being greater 0° and less than 90°. Also, the first surface 162 and the second surface 164 can be formed such that the first angle θ1 and the second angle θ2 are the same, for example, 45°. Also, when the first angle θ1 and the second angle θ2 are not 0° and different from each other, the first surface 162 and the second surface 164 can be formed such that the first angle θ1 and the second angle θ2 each are within a range of being greater 0° and less than 90°. Also, when the first angle θ1 is greater than 0° and less than 90°, the second angle θ2 can be formed to have a negative angle.

Preferably, the first angle θ1 is not less than 20° and not greater than 80° while the second angle θ2 is not less than −15° and not greater than 45°. When the first angle θ1 is less than 20°, the number of the swirl prevention units 160 increases. When the first angle θ1 is greater than 80°, since the interval of the swirl preventions units 160 increases, the effect is decreased.

The shroud 100 which can prevent noise and improve an efficiency of air flow can be obtained by forming the swirl prevention units 160 using the above various relationships between the first angle θ1 and the second angle θ2, and selecting an optimal swirl prevention unit through tests thereof.

The swirl prevent units 160 can be arranged to be continuously connected to one another or intermittently arranged to have a predetermined interval therebetween.

Figure 7A:
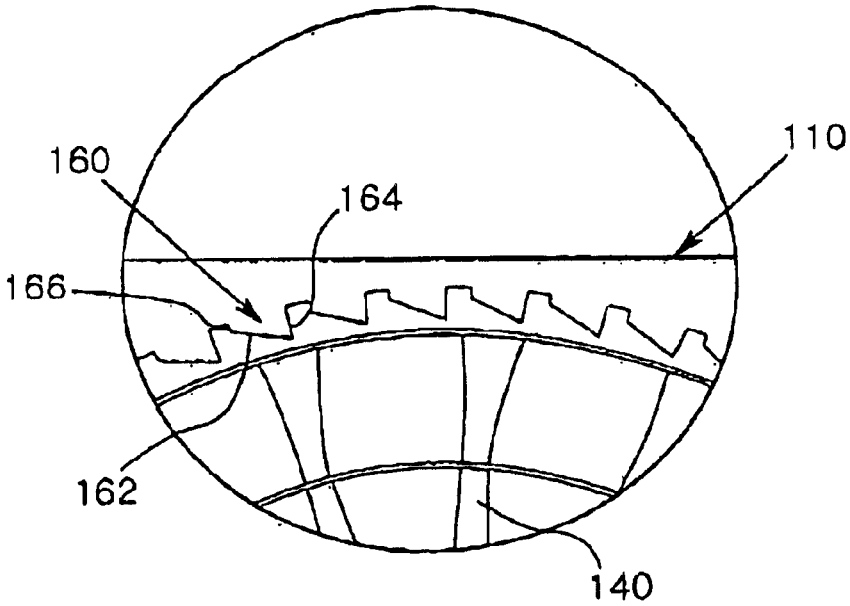
FIGS. 7A, 7B, and 7C are front side views illustrating shrouds according to other preferred embodiments of the present invention.

In the case of intermittently arranging the swirl prevention units 160, to prevent the first surface 162 of each of the continuously arranged swirl prevention units 160 from being connected to the second surface 164 adjacent to the first surface 162, as shown in FIG. 7A, the end portion of the first surface 162 is cut so that a predetermined interval is formed between the swirl prevention units 160 by a cut portion 166. As a result, the swirl prevention units 160 can be intermittently arranged.

Figure 7B:
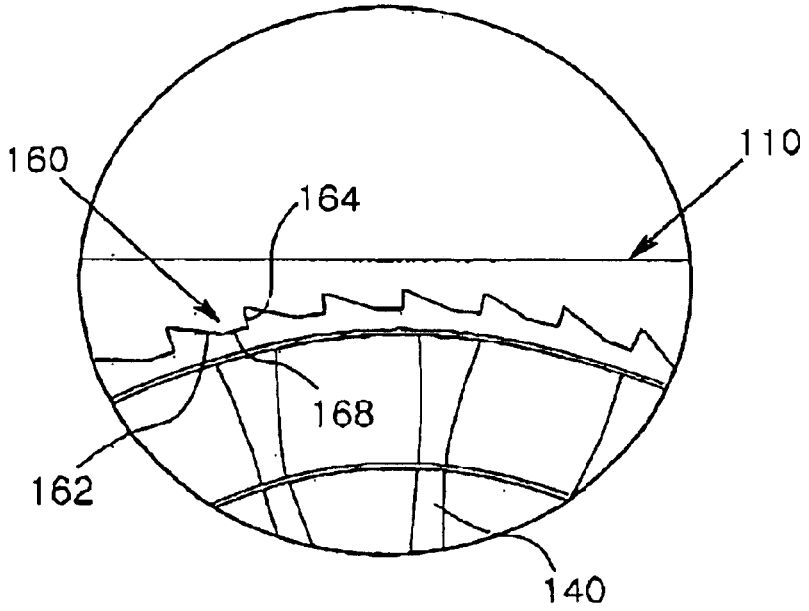
Figure 7C:
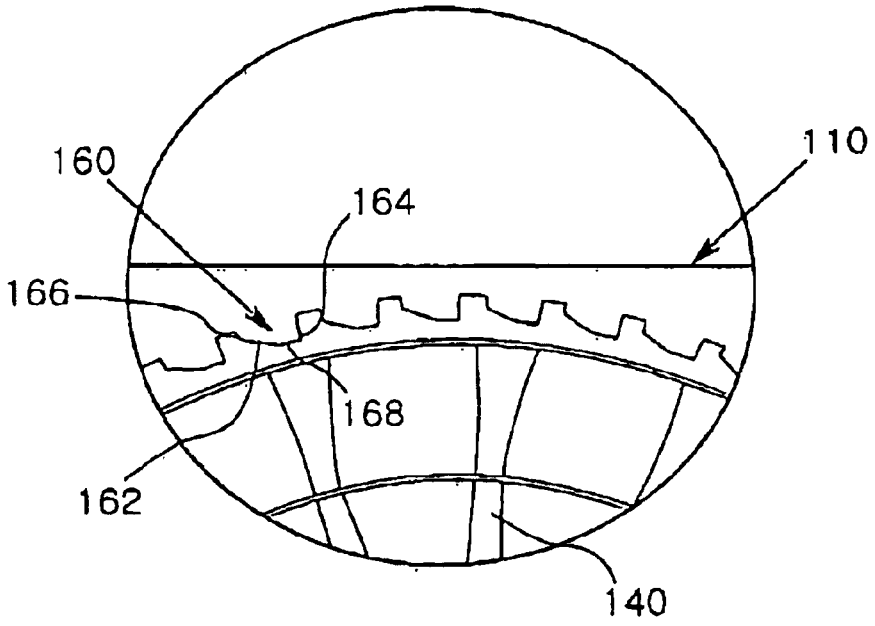

Also, as shown in FIGS. 7B and 7C, the swirl prevention units 160 can include a third surface 168 connecting the first surface 162 and the second surface 164. In this case, the third surface 168 preferably has a curvature whose radius is defined by a length from the center of the airflow inlet 120 to the third surface 168.

Although the first surface and the second surface are connected by the third surface in the above-described preferred embodiment, the present invention is not limited thereto and the first and second surfaces can be connected by a plurality of surfaces.

In the meantime, outer saw-teeth 170 corresponding to the swirl prevention units 160 are preferably formed on an outer circumferential surface of the airflow inlet 120, that is, an outer circumferential surface of the guide ring portion 150, corresponding to the swirl prevention units 160. When the outer saw-teeth 170 are formed on the outer circumferential surface of the guide ring portion 150 corresponding to the swirl prevention units 160, since the guide ring portion 150 has a wrinkled shape which is structurally stable without increasing the thickness of the swirl prevention units 160, a strength enduring vibrations of a car can be maintained.

Next, in the operation of the fan and shroud assembly having the above structure according to the present invention, the motor (not shown) is supported by the motor support ring 130 of the shroud 100. The fan 200 is inserted in the airflow inlet 120 from the front side of the shroud 100. Then, the hub 230 (refer to FIG. 3) of the fan 200 is coupled to the shaft of the motor. This assembly is supported on the rear surface of the heat exchanger (not shown) from the front side of the assembly, that is, from the side where the fan 200 is installed corresponding to the upstream of the airflow in FIG. 5. When the motor is driven in this state, the fan 200 is rotated in the airflow inlet 120.

When the fan 200 rotates, air is sucked from the front side of the heat exchanger located in front of the fan and shroud assembly toward the heat exchanger by a suction force due to the rotation of the blades 210 of the fan 200 and the air passes through the heat exchanger. When the air passes through the heat exchanger, the heat exchange medium flowing in the heat exchanger can be cooled by the air passing through the heat exchanger. The air passing through the heat exchanger is guided by the housing 110 toward the airflow inlet 120. In other words, the amount of air flowing from the front side of the heat exchanger toward the heat exchanger is increased by the shroud 100.

Figure 8A:
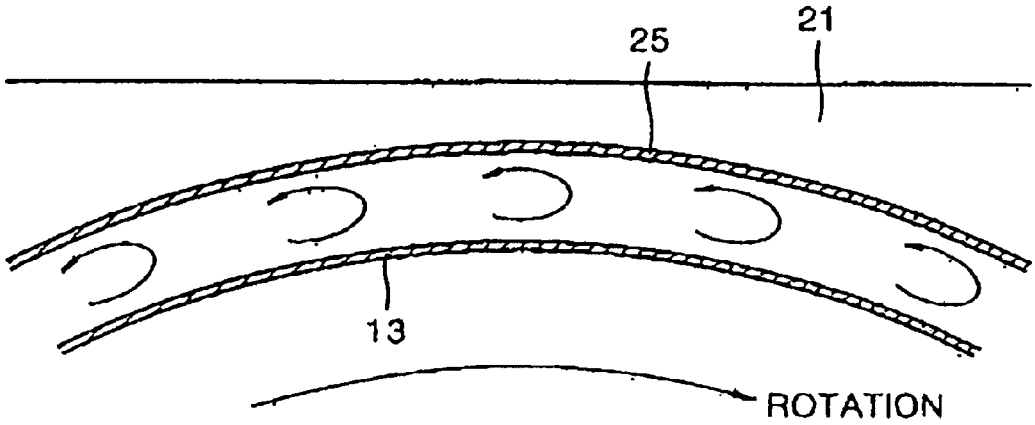
FIG. 8A (PRIOR ART)
FIG. 8A is a view illustrating the movements of turbulence and vortex generated between the conventional fan band and the guide ring portion.
Figure 8B:
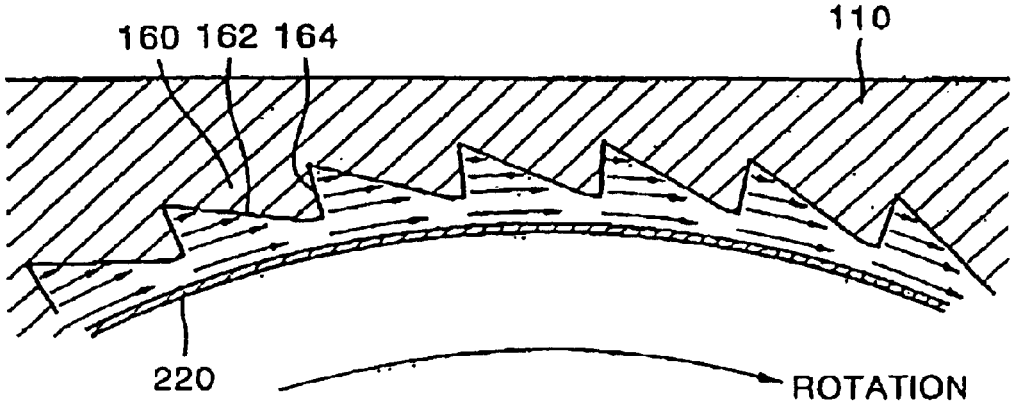
FIG. 8B is a view illustrating reduction of the air swirling generated between the fan band and the guide ring portion according to the present invention.

The air guided by the housing 110 of the shroud 100 toward the airflow inlet 120 is smoothly exhausted by the bell mouth 180 to the rear side of the shroud 100 between the blades 210. In this process, as shown in FIG. 8A, according to the conventional technology, turbulence and a vortex are generated in an annular space between the band 13 connecting the end tips of the blades 12 that is rotating and the guide ring portion 150 of the shroud 100 that is fixed. However, in the present invention, as shown in FIG. 8B, for example, the vortex is effectively restricted by the swirl prevention units 160 having the first surface 162 inclined in the direction in which the fan 200 rotates.

In detail, as the fan 200 rotates, a vortex flowing in the direction in which the fan 200 rotates is generated in the annular space between the band 220 and the inner circumferential surface of the guide ring portion 150. This vortex causes tip vortex noise generated at the tip of the fan 200. In the present invention, the swirl prevention units 160 are formed on the inner circumferential surface of the guide ring portion 150 and the swirl prevention units 160 have the shape in which the length of the circular arc 163 passing each of the swirl prevention units 160 with respect to the center of the shroud 100 decreases as it is closer to the center of the shroud 100, so that the flow of the vortex can be immediately prevented. That is, as the generated vortex flows along the band 220 and passes through the decreasing space formed by one surface of the swirl prevention units 160, for example, the first surface, and the outer circumferential surface of the band 220, the vortex is compressed and then greatly reduced.

The above effect is not generated only when the band 220 is present. When there is no band, such an effect can be generated between the first surface and a circumference connecting the end tips of the blades 12 formed according to the rotation of the fan 200.

Accordingly, since an air vortex phenomenon is drastically reduced inside the inner circumferential surface of the guide ring portion 150 of the shroud 100, airflow is smooth. Thus, since the amount of air passing through the heat exchanger increases, an efficiency of cooling of the heat exchanger is improved. Also, as the air vortex phenomenon is drastically reduced, noise is reduced.

The present inventors measured noise and the amounts of air of the conventional fan and shroud assembly and the fan and shroud assemblies according to the present invention under the conditions of the same rotation speed of the fan 200. Here, the fan and shroud assemblies according to the present invention are made to have the same specifications except for the arrangement of the swirl prevention units 160 and the gap between the swirl prevention units 160 and the band 220. As a result, it can be seen that noise is reduced by at least 2.0 dB in all the fan and shroud assemblies according to the present invention, compared to the conventional fan and shroud assembly.

Also, according to the result of measurement of the weight of the conventional shroud and the shroud 100 according to the present invention, it can be seen that the weight of the shroud 100 according to the present invention is lighter by at least 10% than the conventional shroud since the shroud 100 according to the present invention has only one guide ring portion 150 while the conventional shroud has the outer guide ring and the inner guide ring to form an airflow inlet.

Figure 9:
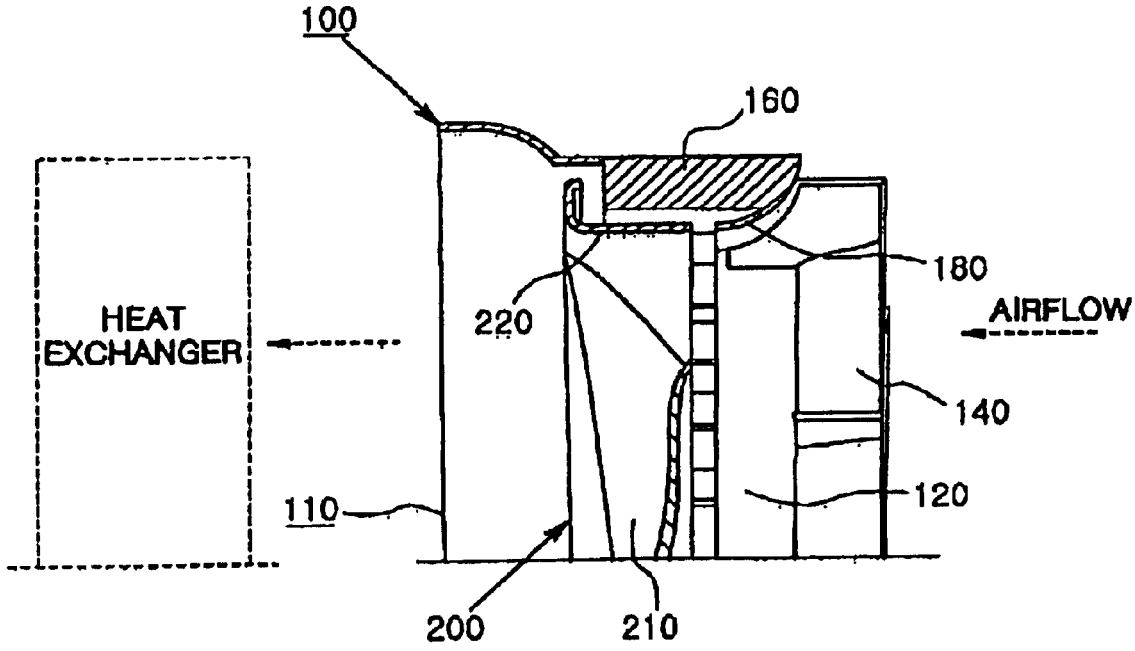
FIG. 9 is a sectional view illustrating a pusher type fan and shroud assembly according to another preferred embodiment of the present invention.
Figure 10:
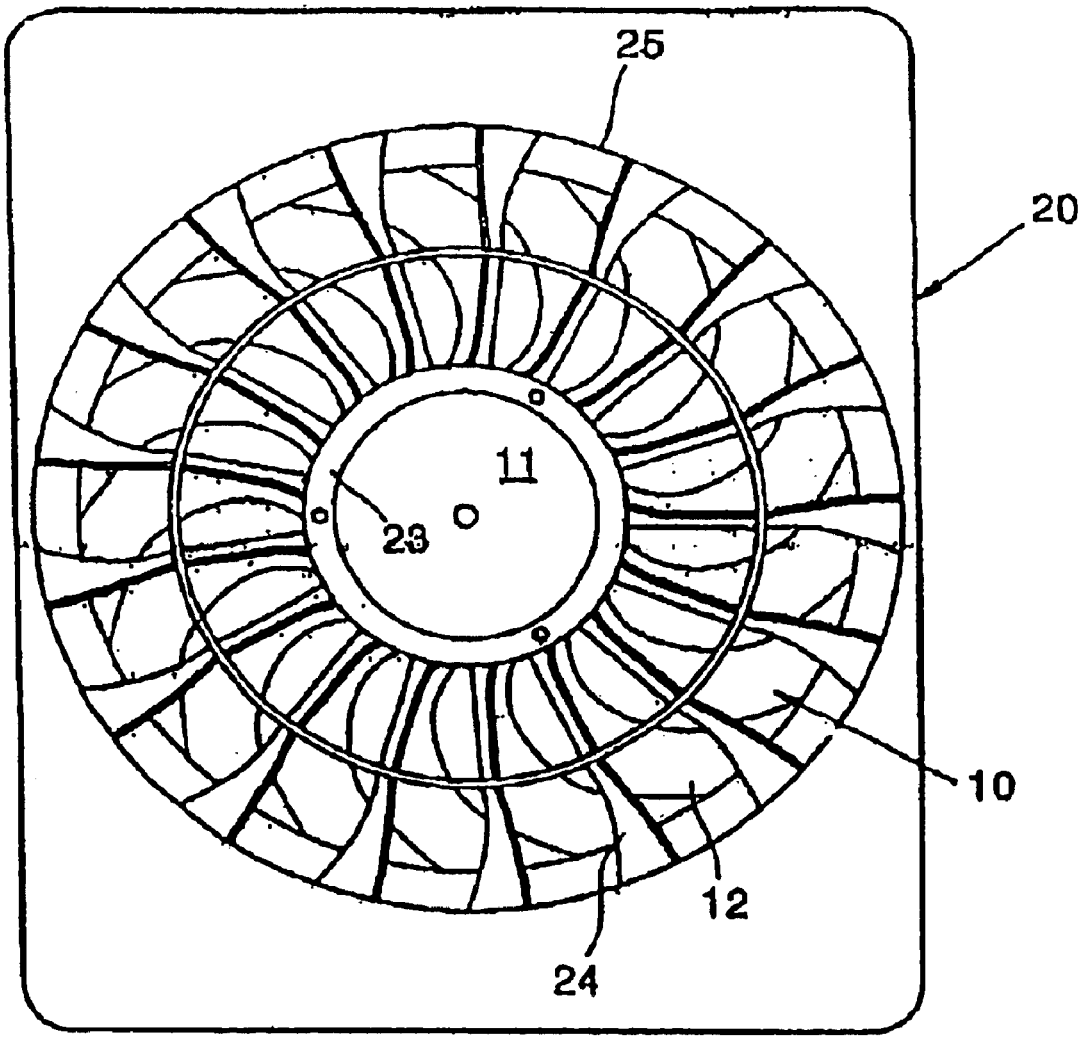
FIG. 10 (PRIOR ART)
FIG. 10 is a rear side view illustrating an example of a conventional fan and shroud assembly.
Figure 11:
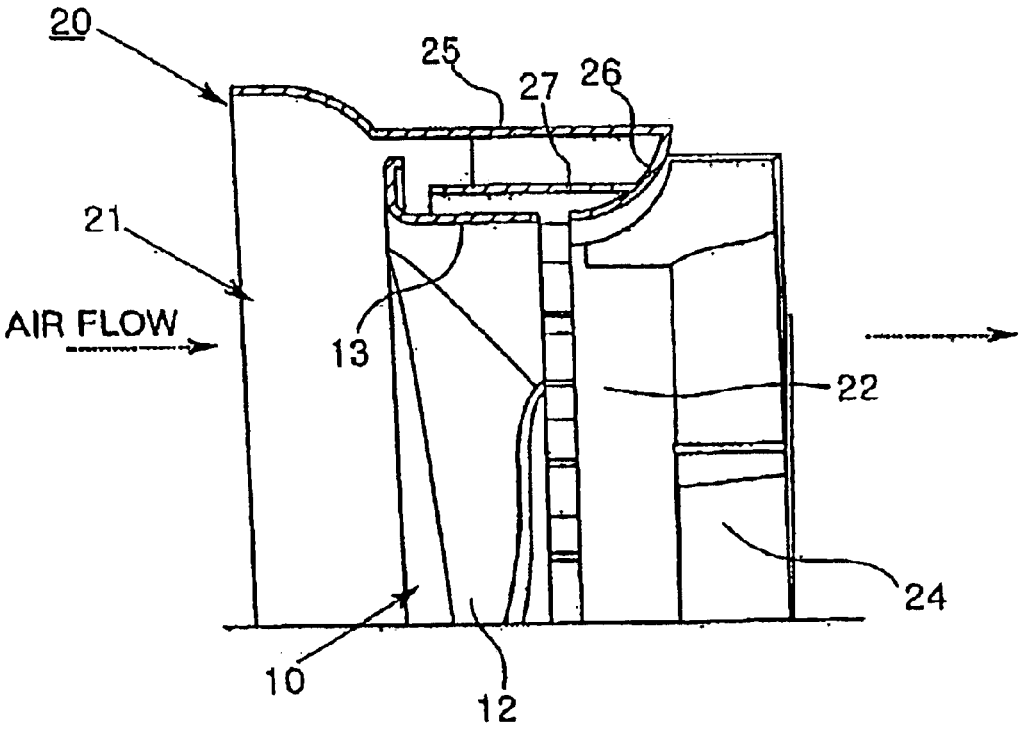
FIG. 11 (PRIOR ART)
FIG. 11 is a sectional view illustrating part of the fan and shroud assembly of FIG. 10.
Figure 12:
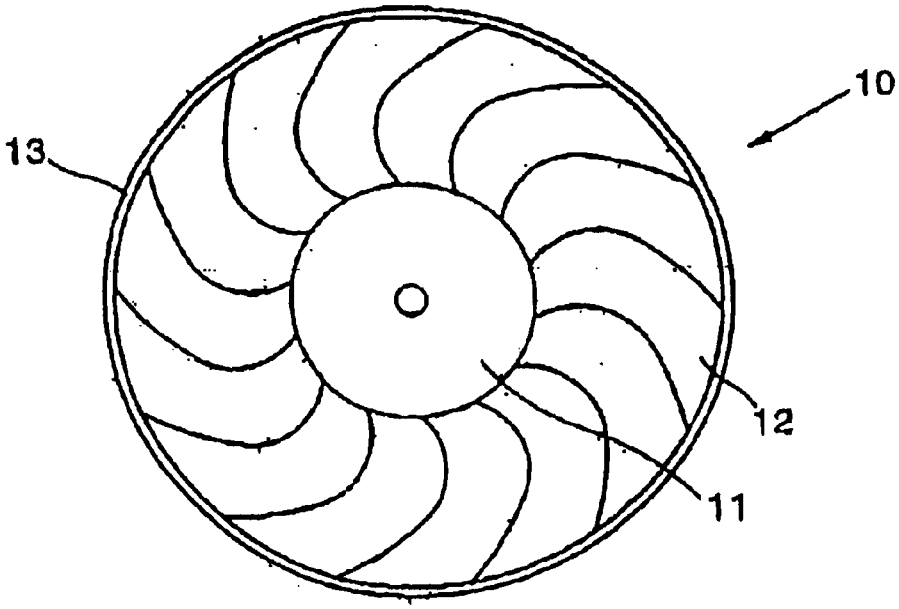
FIG. 12 (PRIOR ART)
FIG. 12 is a front side view illustrating an example of the conventional fan.

Although the shroud applied to the puller type fan and shroud assembly is described and illustrated in the above, the swirl prevention units can be applied to a shroud which is applied to a pusher type fan and shroud assembly as shown in FIG. 9 in which air is sucked and blown toward the heat exchanger after passing through the fan and shroud assembly, which is within the scope of the preset invention as well.

As described above, in the fan and shroud assembly having the above structure according to the present invention, since the swirl prevention units having an inclined surface in a direction in which the fan rotates are arranged along the inner circumferential surface of the airflow inlet, that is, the inner circumferential surface of the guide ring, to have a predetermined gap with the end tips of the blades of the fan, or the fan band, the air vortex phenomenon is reduced at the guide ring portion so that an efficiency of airflow is improved and noise is reduced as well. Therefore, a cooling efficiency to the heat exchanger can be improved and a quiet driving of a car is available.

Also, since the shroud according to the present invention includes only one guide ring portion to form the airflow inlet unlike the conventional shroud, the overall weight of the assembly can be reduced. Accordingly, when the assembly is installed in a car, fuel can be saved due to the decreased weight of the car.

What is claimed is:

1. A fan and shroud assembly comprising:

a fan having a hub rotating around one shaft and a plurality of blades extending outwardly from the hub;

a shroud encompassing the fan to adjust airflow by rotation of the fan;

a guide ring portion located at a position where a predetermined gap exists between the shroud and a circumference connecting end tips of the blades so that the fan is supported by the shroud and rotates; and a plurality of swirl prevention units integrally formed with the guide ring portion to prevent a vortex from proceeding along the circumference in the predetermined gap, each swirl prevention unit having a shape in which the length of a circular arc centered about an axis of rotation of the one shaft and passing through each of the swirl prevention units decreases as the arc is closer to the center of the shroud.

2. The assembly as claimed in claim 1, wherein each of the swirl prevention units comprises a first surface facing a direction in which the fan rotates and a second surface facing opposite to the direction in which the fan rotates.

3. The assembly as claimed in claim 2, wherein a first angle made by the first surface and a radius line from the center of the shroud to the first surface is greater than a second angle made by the second surface and the radius line.

4. The assembly as claimed in claim 3, wherein the first angle is not less than 20° and not greater than 80° while the second angle is not less than −15° and not greater than 45°.

5. The assembly as claimed in claim 3, wherein the swirl prevention units are arranged to be continuously connected to one another.

6. The assembly as claimed in claim 2, wherein each of the swirl prevention units further comprises a third surface connecting the first and second surfaces.

7. The assembly as claimed in claim 6, wherein a first angle made by the first surface and a radius line from the center of the shroud to the first surface is greater than a second angle made by the second surface and the radius line.

8. The assembly as claimed in claim 7, wherein the third surface has a curvature whose radius is defined by a length from the center of the shroud to the third surface.

9. The assembly as claimed in claim 7, wherein the first angle is not less than 20° and not greater than 80° while the second angle is not less than −15° and not greater than 45°.

10. The assembly as claimed in claim 1, wherein the fan further comprises a band connecting the end tips of the blades.

11. The assembly as claimed in claim 1, wherein the guide ring portion further comprises a bell mouth extending to the inside of the guide ring portion at a rear end of the guide ring portion located at a rear side of the shroud and bent such that a path through which air passes is decreased toward the inside of the guide ring portion.

12. The assembly as claimed in claim 1, wherein the fan and shroud assembly sucks air and blows the air toward a heat exchanger.

* * * * *